US005125308A

United States Patent [19]

Mendenhall

[11] Patent Number: 5,125,308

[45] Date of Patent: Jun. 30, 1992

[54] SOFT CORE CUTTING BLADE ASSEMBLY FOR HYDRAULIC FOOD CUTTING APPARATUS

[76] Inventor: George A. Mendenhall, 4252 S. Eagleson Rd., Boise, Id. 83705

[21] Appl. No.: 667,216

[22] Filed: Mar. 11, 1991

[51] Int. Cl.[5] ..... B26D 1/03; B26D 7/20

[52] U.S. Cl. ..... 83/857; 83/402; 83/932

[58] Field of Search ..... 83/402, 856, 857, 858, 83/932

[56] References Cited

U.S. PATENT DOCUMENTS

| | | | |
|---|---|---|---|
| 2,513,391 | 7/1950 | Marasco | 83/857 X |
| 3,109,468 | 11/1963 | Lamb et al. . | |
| 4,059,037 | 11/1977 | Gerson et al. | 83/857 |
| 4,082,024 | 4/1978 | Hodges et al. | 83/402 |
| 4,300,429 | 11/1981 | Brown et al. | 83/857 X |
| 4,766,793 | 8/1988 | Fischer et al. | 83/402 X |
| 5,009,141 | 4/1991 | Julian et al. | 83/402 X |
| 5,058,478 | 10/1991 | Mendenhall | 83/857 |

FOREIGN PATENT DOCUMENTS

| | | | |
|---|---|---|---|
| 8700507 | 10/1988 | Netherlands | 83/857 |

*Primary Examiner*—Douglas D. Watts
*Assistant Examiner*—Rinaldi Rada
*Attorney, Agent, or Firm*—Frank J. Dykas; Craig M. Korfanta; Ken J. Pedersen

[57] ABSTRACT

A cutter blade assembly (10) for cutting soft core vegetable stuffs using a hydraulic cutting apparatus. The cutter blade assembly (10) is constructed from a front inlet adapter plate (12) having an inner longitudinal passage (28) therethrough. Pyramidal knife supports (14) and (16) are attached on opposite sides of the longitudinal passage (28) to the back side of front inlet adapter plate (12) to form a pyramidal frame. A plurality of strip knives (18) are attached in a staggered, inclined and parallel arrangement to form a sequential cutting grid of inclined knives to permit cutting of soft core food stuffs.

3 Claims, 11 Drawing Sheets

SOFT CORE CUTTING BLADE ASSEMBLY FOR HYDRAULIC FOOD CUTTING APPARATUS

BACKGROUND OF THE INVENTION

1. Technical Field

This invention relates to the cutting of food product with hydraulic food cutting apparatus. More particularly, this invention relates to an improved blade assembly for cutting segments of food product from soft core food stuff such as pickles, tomatoes, etc.

2. Background Art

Heretofore, soft core fruits and vegetables necessarily have been cut or sliced by mechanical means which are cumbersome, of low tonnage capacity, and expensive.

As an alternative to mechanical cutters for solid core vegetable products, a class of devices known as hydroknives were developed. Hydroknives suspend the food product in a carrier medium, usually water, and pump it through an alignment and acceleration tube which is similar in shape and function to the front half of a venturi, and from there into a longitudinal passageway holding a cutter blade assembly. The food product, traveling at speeds of approximately 60 feet per second, impinges against the cutter blade assembly and is cut into a plurality of segments. Such hydroknife cutting apparatus have the distinct advantage of higher capacity when compared to their mechanical counterparts, but until now, have been limited to solid core food stuffs. This is simply a consequence of the physics of the device, which operates on the basic principle of momentum. Unfortunately, the forces encountered during the deceleration of the food stuff due to impact with the cutter blades, cause deformation of the soft core food stuff and result in the soft core food stuffs being ripped apart.

F. G. LAMB, ET AL., U.S. Pat. No. 3,109,468, discloses a typical hydraulic cutting apparatus wherein solid core food stuffs to be cut, namely potatoes, are dropped into a tank filled with water and then pumped through conduit into an alignment chute wherein the vegetables are aligned and accelerated to a high speed before impinging upon a cutter blade assembly. Here, the potato core is cut into a plurality of french fries and the peripheral area of potato is sliced off and diverted from the main flow of core product for later retrieval for other uses. The cutter blade assembly as taught by LAMB, is incapable of efficiently cutting soft core vegetable stuffs without the vegetable being torn apart, as the frictional resistance encountered at the cutting edge is simply too great.

BROWN, ET AL., U.S. Pat. No. 4,300,429, teaches a cutter blade assembly which cuts french fry strips of varying cross-sectional area to compensate for the non-uniform solids content between the center of the potato and the peripheral areas so that the end product french fries will cook at a uniform rate. Like LAMB, the BROWN ET AL device is not suitable for cutting soft core food stuffs, as the resistance encountered in this cutting arrangement is greater than that of the Lamb device.

Generally speaking, the prior art cutter assemblies all have an array of blades, usually in matching pairs, which cut simultaneously, thus causing substantial resistive forces upon impact of the vegetable's skin with the cutter blades. The resulting stress literally tears the soft core food stuffs apart from the inside out.

My U.S. patent application Ser. No. 07/344,241, incorporated herein by reference, teaches a staggered cutting blade array which greatly reduces the resistive forces experienced by solid core food stuffs during the cutting process. This cutter configuration works well for cutting solid core vegetables, such as potatoes or the like, into strips or "strings" of very small cross-sectional area. However, even this configuration does not work well for cutting soft core fruits and vegetables such as cucumbers, pickles, tomatoes, etc.

What is needed is a hydraulic cutter blade assembly which is capable of cutting soft core vegetables when used in a typical hydraulic cutting apparatus without causing cell damage to the interior of the vegetable.

Accordingly, it is an object of this invention to provide a cutter blade assembly which can be utilized in a hydraulic food cutting apparatus to cut a soft core food product. It is a further object of this invention to provide a blade assembly for a hydraulic food cutting apparatus for cutting soft core fruits and vegetables into slices or slabs. It is still a further object of this invention to provide a blade assembly for a hydraulic food cutting apparatus for cutting soft core fruits and vegetables into strips or strings having a relatively small cross-sectional area.

DISCLOSURE OF INVENTION

These and other objects are achieved by use of a cutter blade assembly which has its blades configured to present a staggered and sequential series of inclined or slanted cutting knife arrays. In a first embodiment, a pair of asymmetrical pyramidal knife supports are attached at their bases, which define their upstream ends, to an inlet adapter plate. The pyramidal knife supports are mirror images of one another and are configured to present a plurality of parallel knife attachment surfaces along the longitudinal axis or food path.

A plurality of strip knives are attached to the attachment surfaces, each being disposed at an incline with respect to the plane of the inlet adapter plate. Additionally, by sequentially arranging the arrays of strip knives, the food product being cut is not subjected to substantial compressive forces which can cause cellular damage.

The positioning of the strip knives at a slant or incline, creates the equivalent of a transverse slicing action which significantly reduces the cutting resistance and allows the soft core food stuffs to be cut without damage. This slicing phenomena will be explained in some detail in the following disclosure. The pyramidal frame members define a set of coordinate planes with the first plane being between and normal to the frame members and coincident with the longitudinal axis. The second plane is parallel to the frame members and also coincident with the longitudinal axis. Pair of strip knives are attached to the frame members, with each strip knife spanning between the two frame members being held in equidistant parallel spaced relationship to the first plane and intersecting the second plane at equal but opposite angles of intersection.

BEST MODE FOR CARRYING OUT INVENTION

Figure 1:
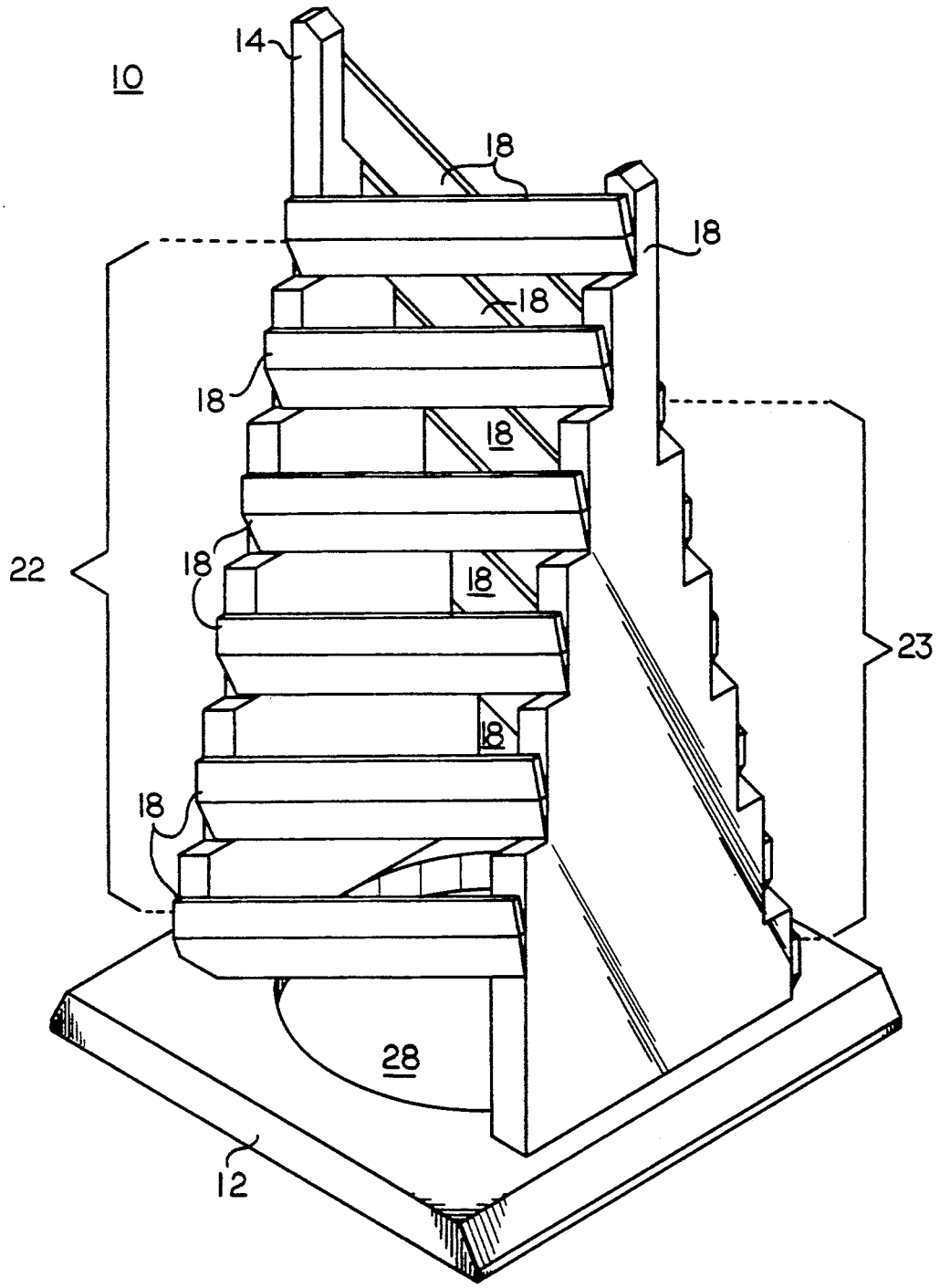
FIG. 1 is a representational perspective view of a first embodiment of my new cutter blade assembly.
Figure 2:
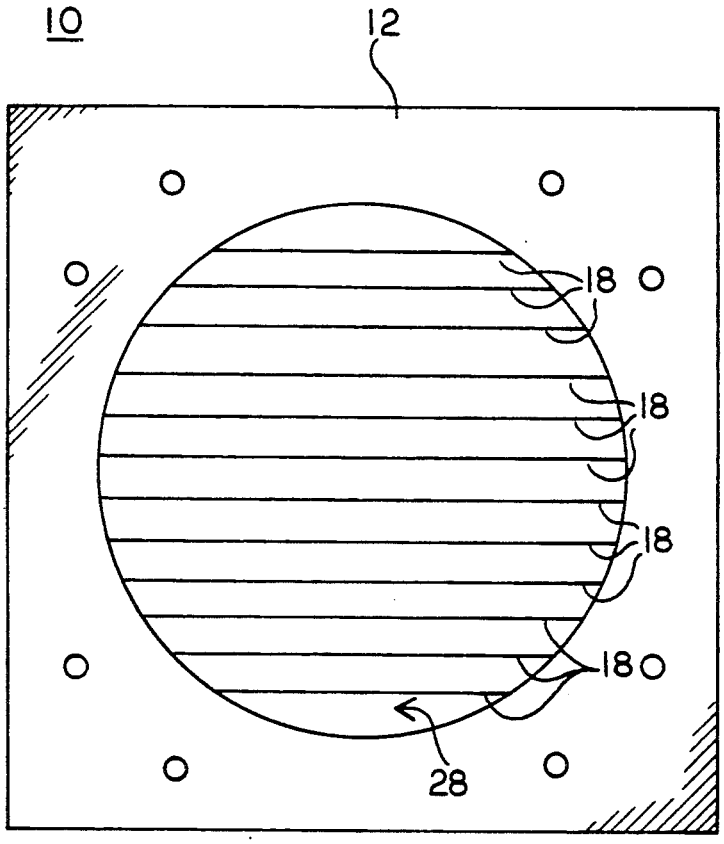
FIG. 2 is an upstream plan view of the first embodiment.
Figure 3:
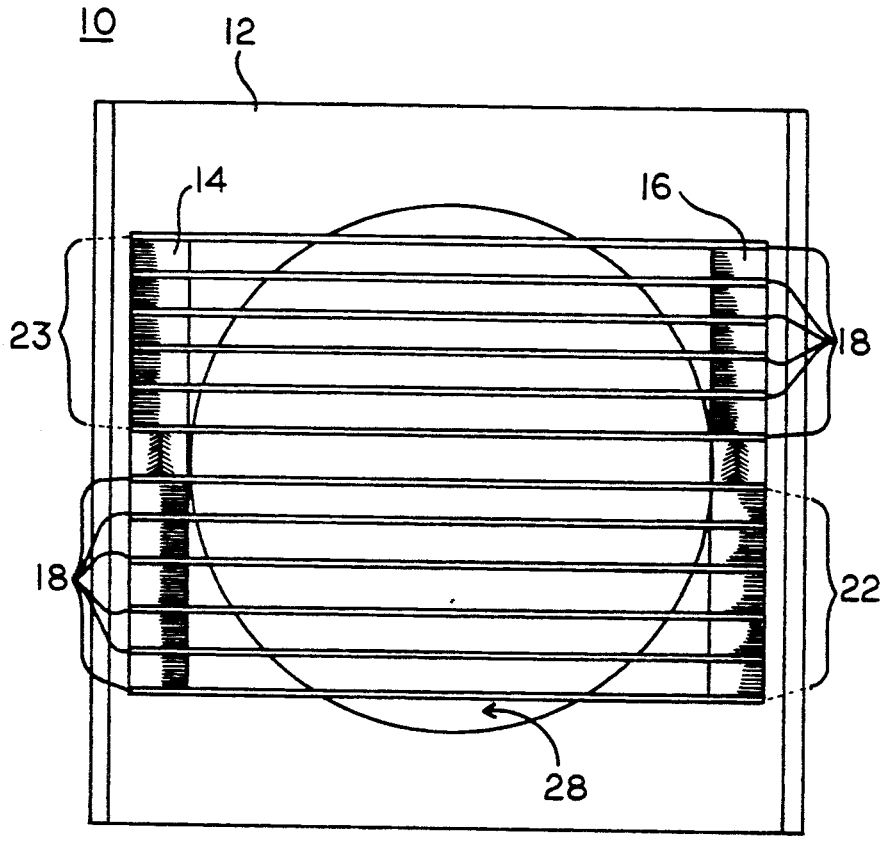
FIG. 3 is a downstream plan view of the first embodiment of the cutter blade assembly.
Figure 4:
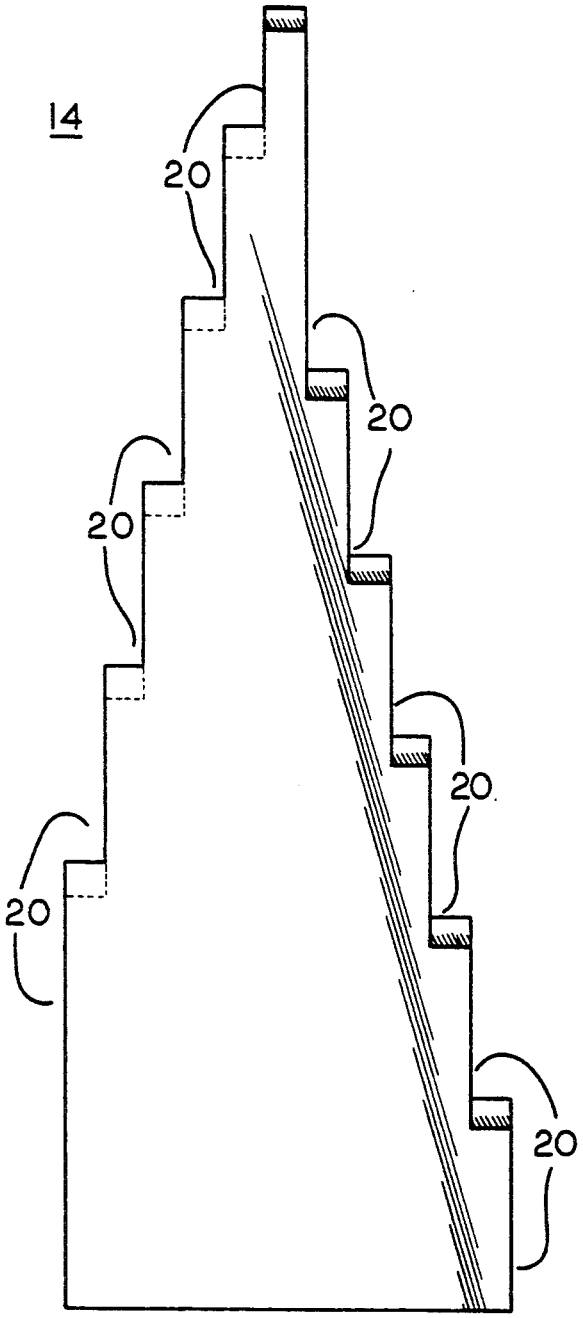
FIG. 4 is a first side view of a first pyramidal frame member.
Figure 5:
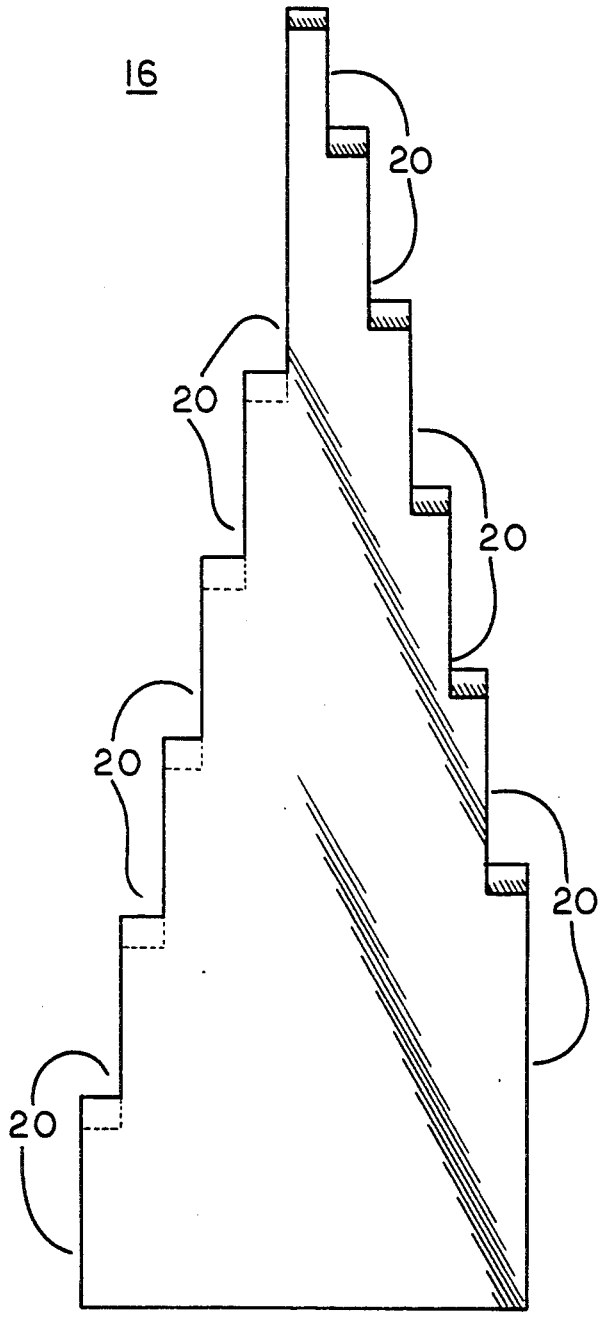
FIG. 5 is a first side view of a second pyramidal frame member.
Figure 6:
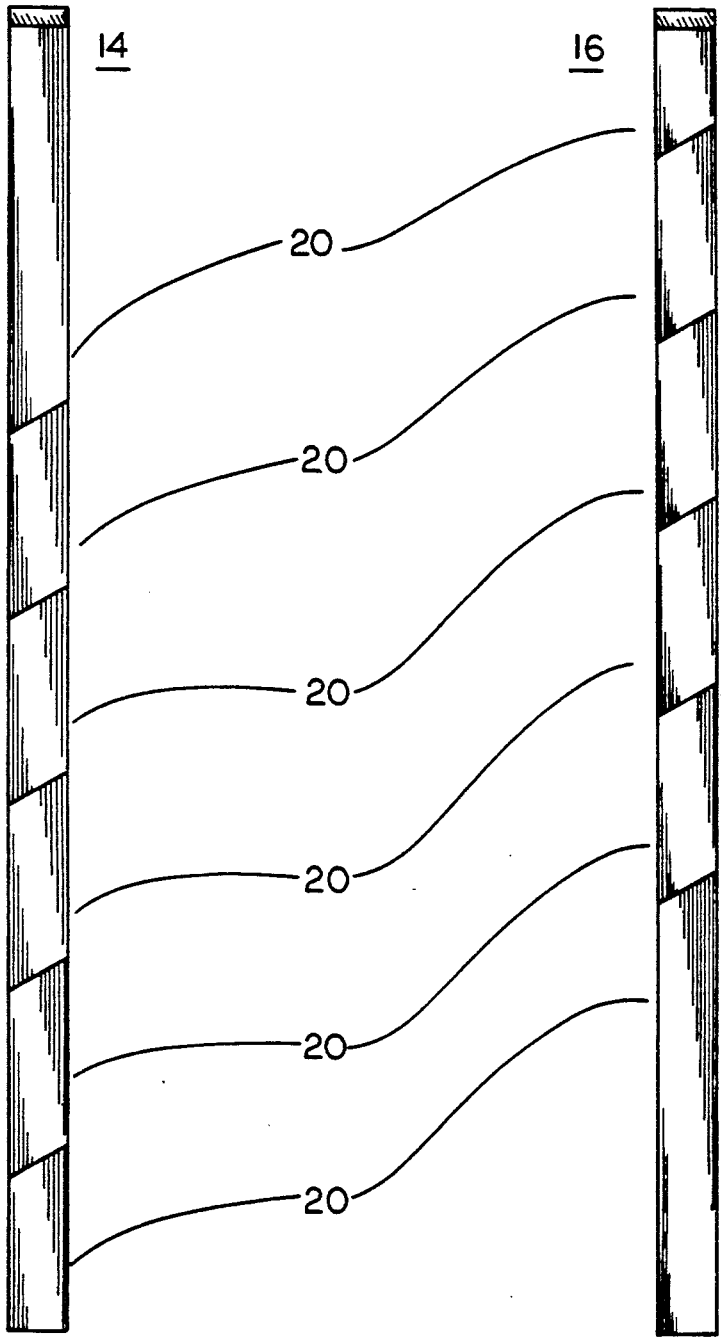
FIG. 6 is a second side view of the first and second pyramidal frame members.

Referring now to FIGS. 1 through 7, a first embodiment of my cutter blade assembly, generally designated as 10, is shown. This cutter blade assembly is capable of producing relatively small longitudinal cuts of soft core fruit and vegetable products without the feather cuts and cell damage characteristic of most of the prior art cutter configurations. FIG. 1 shows cutter blade assembly 10 resting face down on front inlet adapter plate 12. In use, the cutter blade assembly would be oriented so as to receive food product and carrier medium through the hole in front inlet adapter plate 12, after which it travels generally along the longitudinal centerline of the cutter blade assembly 10 through staggered arrays 22 and 23 of inclined cutter blades 18 before exiting cutter blade assembly 10. Front inlet adapter plate 12 can be sized so it is retrofittable to virtually any hydraulic food cutting apparatus of the same general type. The longitudinal passage or hole 28 is disposed within front inlet adapter plate 12, as shown in FIGS. 1, 2 and 3.

Asymmetrical pyramidal knife supports 14 and 16 are attached in opposing pairs to the back side of front inlet adapter plate 12 around the perimeter of longitudinal passage 28 to form a generally pyramidal frame which defines a longitudinal passageway along the food path.

As shown in FIGS. 1, 3, 4, 5 and 6, pyramidal knife supports 14 and 16 have a plurality of offset sequentially staggered attachment surfaces 20 disposed in a staggered manner up the sides of pyramidal knife supports 14 and 16. Each attachment surface 20 of knife support 14 has an opposing attachment surface 20 on knife support 16 located equidistant from and parallel to the centerline axis, but offset down the longitudinal passageway of cutter blade assembly 10

Figure 7:
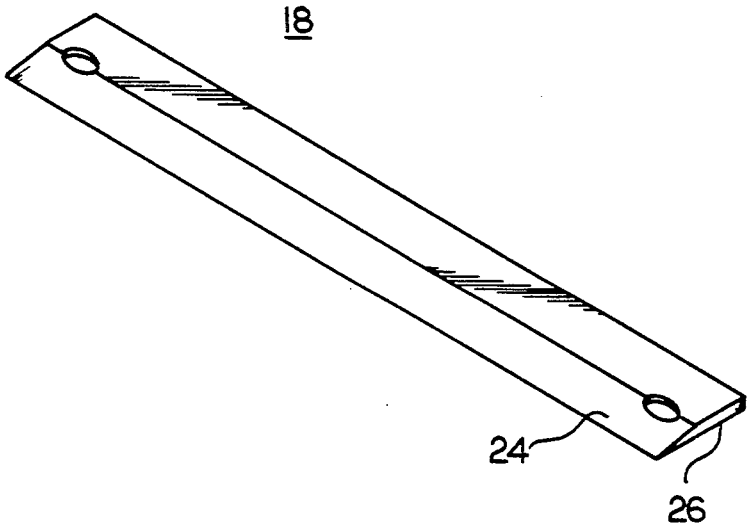
FIG. 7 is a perspective elevational view of a strip knife.
Figure 8:
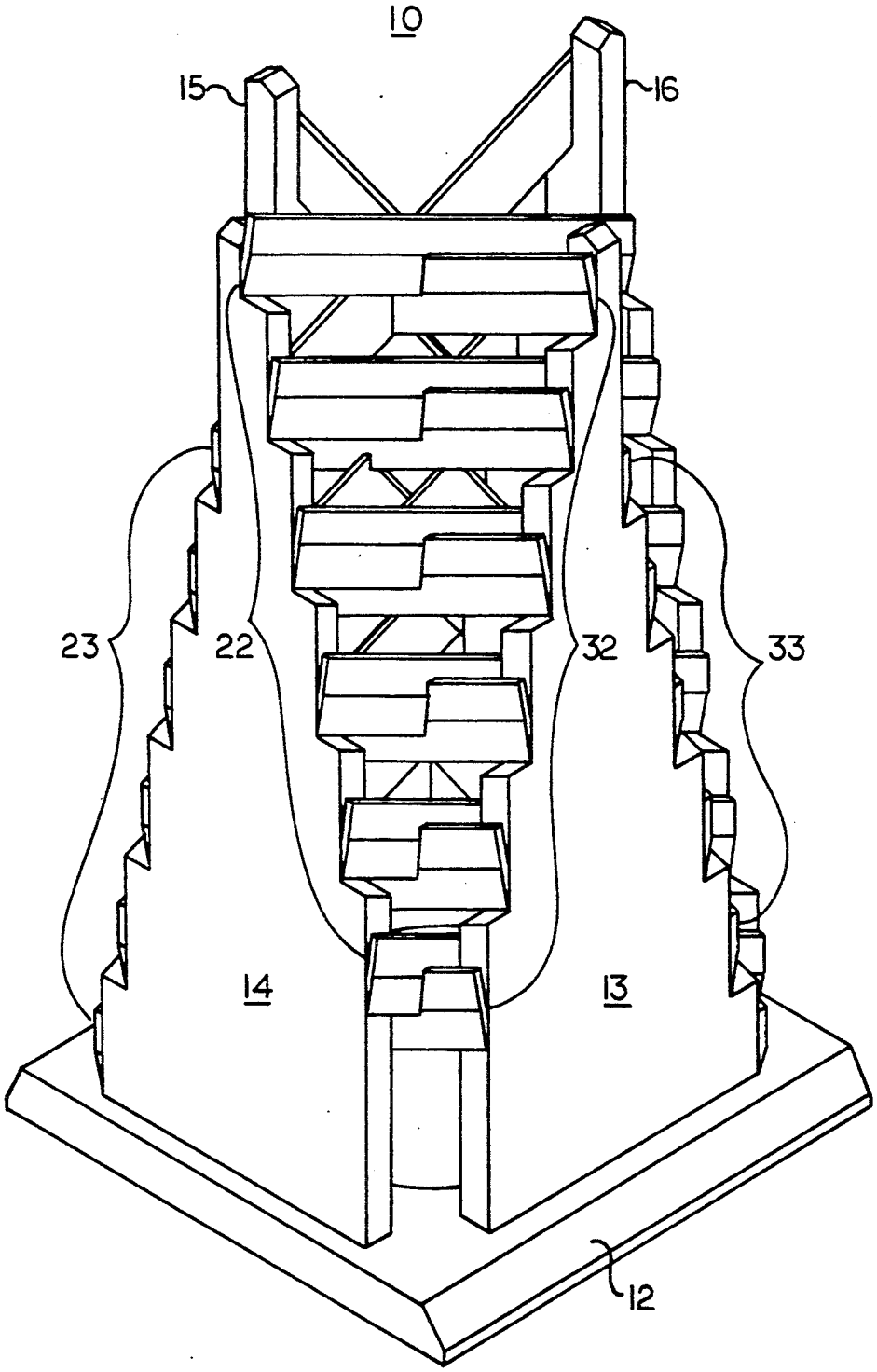
FIG. 8 is a perspective representational view of the second embodiment of my cutter blade assembly.
Figure 9:
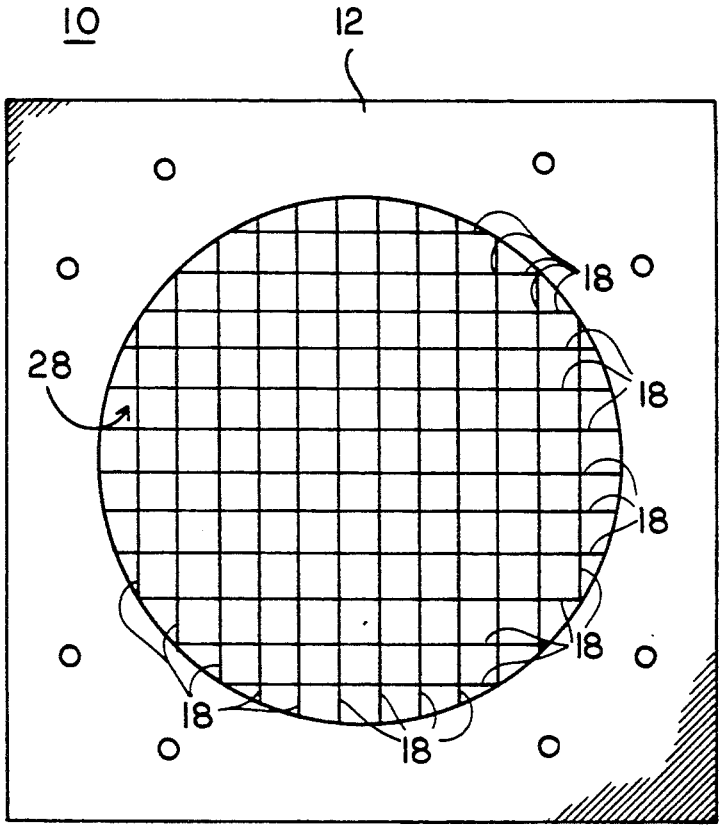
FIG. 9 is a plan view of the upstream inlet end of the second embodiment of my invention.
Figure 10:
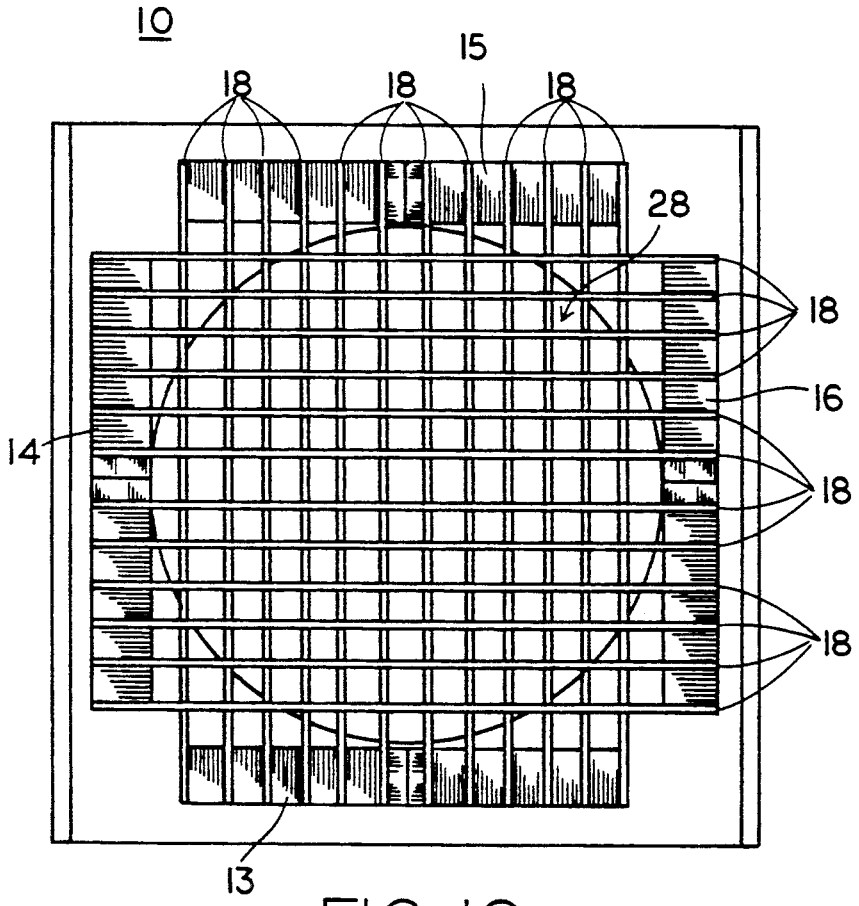
FIG. 10 is a plan view of the discharge end of the second embodiment of my cutter blade assembly.
Figure 11:
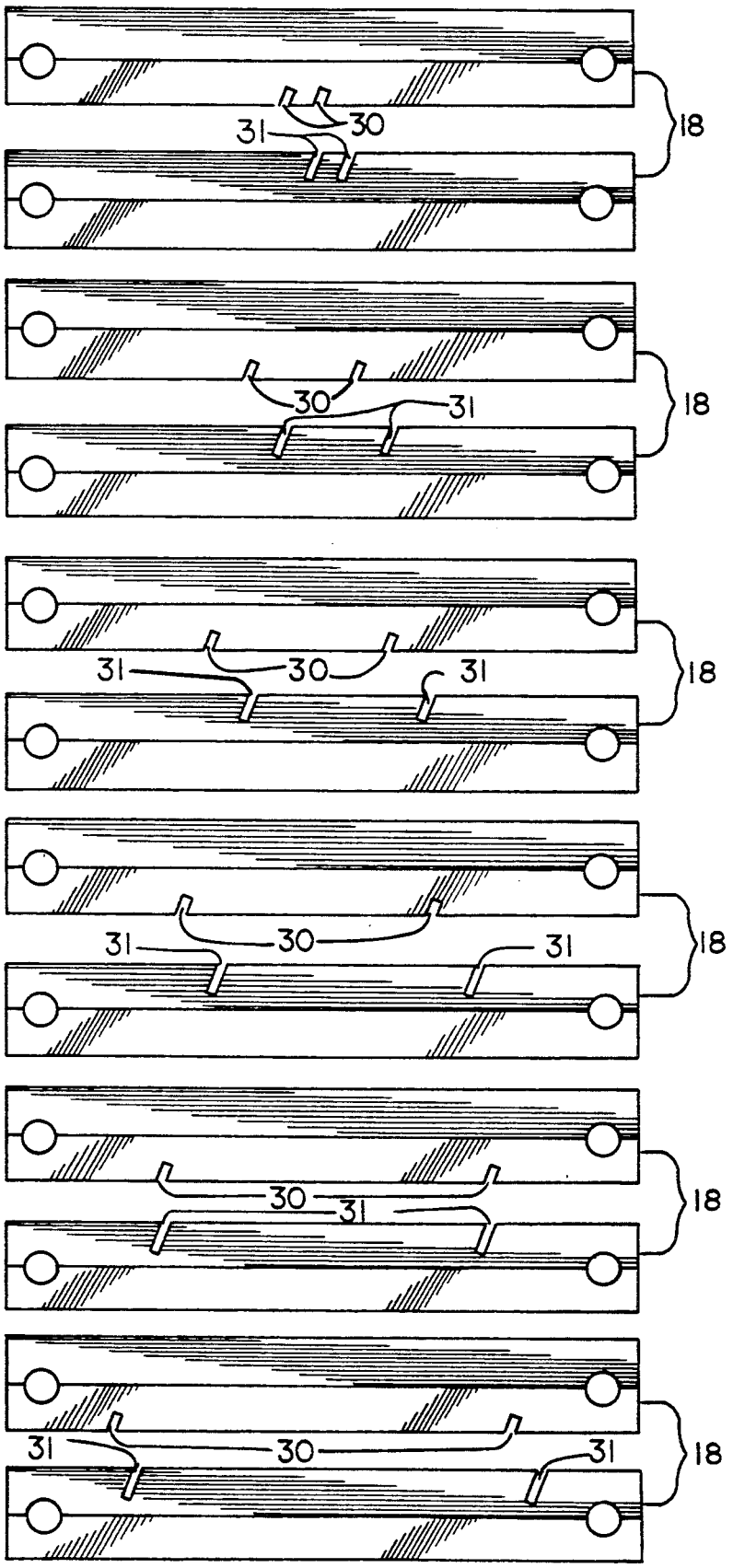
FIG. 11 is a side plan view of the notched strip knives of the second embodiment.

FIG. 7 shows a standard cross strip knife 18. Each knife has a bevelled side 24 and a flat side 26 which form the cutting edge of all the knives. Strip knives 18 are attached to pyramidal knife supports 14 and 16 to form a parallel, sequential, array of cutting blade knives. As can be seen in FIGS. 1, 2 and 3, strip knives 18 are attached to pyramidal knife supports 14 and 16 such that they are all disposed at a particular angle of incline with respect to front inlet adapter plate 12.

When fully assembled, arrays 22 and 23, of inclined strip knives 18, together form a cutting grid, which when viewed from the discharge end of the assembled apparatus, as is shown if FIG. 3, provides for cutting a soft core food product into longitudinal uniform sections area of a particular desired size.

The staggered sequential arrangement for the blades results in the whole food product impinging upon one pair of blades at a time, in sequence, thereby minimizing the drag resulting from shearing and frictional forces during the cutting process. Also, the staggered sequential array of cutting knives eliminates compressive forces on cut food segments due to compression between two or more cutting blades, as is typical of the prior art cutting apparatus.

Again referring to FIG. 1, it can be seen that all of the strip knives 18 are attached to their respective pyramidal frame members in an orientation wherein bevelled side 24 faces out from the longitudinal centerline of the cutter blade assembly. Further, the strip knives are also attached to their respective frame members in an orientation wherein one end of each strip knife is up or downstream in relation to the other end of the strip knife and slanted or inclined in relation to the inlet adapter plate. All of the blades of each individual cutting array 22 or 23 are oriented in the same direction, however, the blades of the separate arrays are oriented in opposite directions.

The primary purpose of positioning the blades at an angle with respect to the longitudinal passageway is to create a slicing action similar to that of a reciprocating blade. It is fairly well known that it requires significantly less downward pressure to cut through an object if the blade is drawn transversely across the object as well as down through it. Almost every chef has had the experience of partially squashing a tomato with a sharp knife because he or she forgot to pull the knife across the surface of the tomato while pressing down on it. Even though this fact is fairly well accepted, it isn't very well understood.

The most plausible and widely accepted explanation relies on surface tension effects. Because of the cohesive forces between the molecules of a substance, a solid or liquid object will deform before it finally separates due to an outside force. This phenomena is attributed to the unbalanced cohesion forces present at the surface of the object. With soft core fruits and vegetables this phenomena is further exaggerated by the natural protective skins grown on the fruit's and vegetable's outer surfaces. However, if on the molecular level the cohesive bonds can be broken before the deforming outside force has an opportunity to randomly tear the bond apart, the substance will remain largely in tact. Hence, by drawing the knife blade across the surface, small molecular sized irregularities and protuberances in the knife blade will separate the cohesive bonds before the downward pressure of the knife blade can tear the bonds apart.

The more difficult task is to apply this principle to a stationary cutting blade. For the purposes of explanation, the reader should imagine a guillotine blade permanently fixed in its up position. Next, the reader needs to define a frame of reference on the cutting edge of the blade with an X axis coincident on the cutting edge and a Y axis lying in the plane of the blade and perpendicular to the X axis, the origin lying at the center of the cutting edge and the positive Y axis extending downward at an angle in the general direction of the ground.

If the blade were allowed to fall, it would appear to one standing at the origin that the object to be cut was falling from the sky with a constant horizontal component of motion. This motion would appear the same, at least from the defined frame of reference, regardless of whether the blade were allowed to fall on the object or if you were to turn the guillotine upside down and allow the object to fall on the blade. The key thing to realize is that there is a horizontal component of motion, that is to say, a component of motion along the X axis. This component provides the equivalent of the slicing or reciprocating blade motion. In essence, the incoming fruit or vegetable sees a reciprocating blade.

A second embodiment of the soft core cutting blade assembly, as is shown in FIGS. 8 through 11, is designed to produce string cuts from soft core fruits and vegetables. Here the design of pyramidal knife supports 13, 14, 15 and 16, in conjunction with the engagement slots 30 in the cutting edges of the strip knives in cutting arrays 22 and 32 and the engagement slots 31 in the trailing edges of the strip knives in cutting arrays 23 and 33, provide for a staggered perpendicular interlocking arrangement of slanted strip knives as is. In both embodiments, the removable attachment of all the strip knives can be accomplished by any suitable means and is here accomplished by the use of allen head bolts and hex nuts which are not shown. It is desirable to provide for removable attachment of the strip knives so that they may be sharpened and replaced as necessary.

While there is shown and described the present preferred embodiment of the invention, it is to be distinctly understood that this invention is not limited thereto but may be variously embodied to practice within the scope of the following claims.

What is claimed is:

1. A cutter blade assembly for use in a hydraulic food cutting apparatus to cut soft core food stuffs which comprises:

a first pair of asymmetrical frame members being fixed in parallel spaced relationship one to the other to define a longitudinal passageway, including a central longitudinal axis and a first central plane parallel to said frame members and coincident with said longitudinal axis, and further having upstream and downstream ends for passage of food product and carrier medium therethrough each frame member of said first pair of frame members being asymmetrical about a respective longitudinal axis of each of said frame members said first pair of frame members having a first plurality of strip knife attachment surfaces disposed thereon to position a first plurality of strip knives into two cutting arrays having an equal number of sequentially positioned and parallel strip knives from the upstream end to the downstream end at incrementally closer distances to the first central plane, said attachment surfaces further disposed to hold the first array of incrementally spaced paralleled strip knives of the first plurality of strip knives for intersection with the first central plane at an inclined angle and the second array of the first plurality of strip knives for intersection with the inclined plane at an equal but opposite inclined angle;

said first plurality of strip knives each having a flat side, a beveled side, a first end and a second end;

each of said first plurality of strip knives being removably attached to two of said first plurality strip knife attachment surfaces and positioned along the longitudinal passageway with said beveled sides facing outward from the central longitudinal axis and disposed having a first end of each knife displaced downstream of that particular knives' second end;

a second pair of asymmetrical frame members being fixed in parallel spaced relationship one to the other about the central longitudinal axis and adjacent said first pair of frame members and further defining a second central plane parallel to said second pair of frame members and coincident with said central longitudinal axis and perpendicular to said first central plane, each frame member of said second pair of frame members being asymmetrical about a respective longitudinal axis of each of said second pair of frame members;

said second pair of frame members having a second plurality of strip knife attachment surfaces disposed thereon to position a second plurality of strip knives into two cutting arrays having an equal number of sequentially positioned and parallel strip knives from the upstream end to the downstream end at incrementally closer distances to the second central plane, said attachment surfaces further disposed to hold the first array of incrementally spaced paralleled strip knives of the second plurality of strip knives for intersection with the second central plane at an inclined angle and the second array of the second plurality of strip knives for intersection with the second central plane at an equal but opposite inclined angle;

said plurality of strip knives each having a flat side, a beveled side, a first end and a second end;

each of said second plurality of strip knives being removably attached to two of said second plurality strip knife attachment surfaces, which both lie in the same plane, and being positioned along the longitudinal passageway with said beveled sides facing outward from the central longitudinal axis and disposed having a first end of each knife displaced downstream of that particular knives' second end; and said first and second pluralities of strip knives being in notched and interlocked engagement, one to the other.

2. A cutter blade assembly for use in a hydraulic food cutting apparatus to cut soft core food stuffs which comprises:

a pair of asymmetrical pyramidal frame members being fixed in parallel spaced relationship one to the other to define a longitudinal passageway, including a central longitudinal axis and a central plane parallel to said frame members and coincident with said longitudinal axis, and further having upstream and downstream ends for passage of food product and carrier medium therethrough, each of said frame members being asymmetrical about a respective longitudinal axis of each of said frame members;

said frame members having a plurality of strip knife attachment surfaces disposed thereon to position a plurality of strip knives into two cutting arrays each having an equal number of sequentially positioned and parallel strip knives from the upstream end to the downstream end at incrementally closer distances to the central plane, said attachment surfaces further disposed to hold the first array of incrementally spaced parallel strip knives for intersection with the central plane at an inclined angle and the second array of strip knives for intersection with the inclined plane at an equal but opposite inclined angle;

said plurality of strip knives each having a flat side, a beveled side, a first end and a second end; and said strip knives being removably attached to said strip knife attachment surfaces along the longitudinal passageway with said beveled sides facing outward from the central plane.

3. A blade cutter assembly for use in a hydraulic food cutting apparatus to cut soft core food stuffs which comprises:

a pair of asymmetrical pyramidal frame members for positioning in parallel spaced relationship to define a longitudinal passageway, having a central longitudinal axis, and upstream and downstream ends, for the passage of food product and carrier medium therethrough, said frame members further defining two coordinate planes with a first plane being between and normal to said frame members and coincident with said longitudinal axis, and a second plane being parallel to said frame members and coincident with said central longitudinal axis, each frame member of said pair of frame members being asymmetrical about a respective longitudinal axis of each of said frame members;

a plurality of paired opposing strip knives, with each strip knife spanning between and being attached to each of the frame members, and with each strip knife having a cutting edge, wherein each cutting edge of each paired strip knife is fixed in equidistant parallel spaced relationship to the first plane and intersects the second plane at equal but opposite inclined angles of intersection at points coincident to a line within said second plane normal to the first plane.

* * * * *